US005810891A

United States Patent [19]

Ham et al.

[11] Patent Number: 5,810,891

[45] Date of Patent: Sep. 22, 1998

[54] PROCESS FOR DYEING WOOL-CONTAINING FIBER MATERIALS

[75] Inventors: Edvard Ham, Basel, Switzerland; Philippe Ouziel, Altkirch, France

[73] Assignee: Ciba Specialty Chemicals Corporation, Tarrytown, N.Y.

[21] Appl. No.: 779,416

[22] Filed: Jan. 7, 1997

[30] Foreign Application Priority Data

Jan. 11, 1996 [CH] Switzerland ..... 81/96

[51] Int. Cl.[6] ..... D06P 3/16; D06M 15/285

[52] U.S. Cl. ..... 8/555; 8/917

[58] Field of Search ..... 8/495, 555, 558, 8/111, 115.6, 128.1, 917

[56] References Cited

U.S. PATENT DOCUMENTS

| | | | |
|---|---|---|---|
| Re. 30,227 | 3/1980 | Von Rütte | 252/301.22 |
| 4,304,567 | 12/1981 | Ballmann et al. | 8/543 |
| 4,433,976 | 2/1984 | Von der Eltz et al. | 8/555 |
| 4,705,526 | 11/1987 | Abel et al. | 8/555 |
| 4,975,524 | 12/1990 | Berendt | 528/366 |
| 5,399,616 | 3/1995 | Kuhn et al. | 524/765 |
| 5,445,655 | 8/1995 | Kuhn et al. | 8/555 |

FOREIGN PATENT DOCUMENTS

| | | |
|---|---|---|
| 0243939 | 11/1987 | European Pat. Off. . |
| 2738494 | 5/1978 | Germany . |
| 2844250 | 4/1980 | Germany . |
| 4101968 | 7/1992 | Germany . |

OTHER PUBLICATIONS

CA 111(24): 215881j Abstract of One–Stage Technology for Dyeing and Finishing of Cotton–Lavsan Shcheglova et al, Izv, Vyssh, Ucheba, Laved., Technol. Tekst. Prom–ste 1989 no month available.

*Primary Examiner*—Margaret Einsmann
*Attorney, Agent, or Firm*—David R. Crichton

[57] ABSTRACT

A process is described for dyeing wool-containing fibre materials with anionic dyes, which comprises dyeing said materials in the presence of a wool protective agent containing at least one acrylamide homo- or copolymer. Rubfast level dyeings having reduced setting can be obtained according to this process.

10 Claims, No Drawings

PROCESS FOR DYEING WOOL-CONTAINING FIBER MATERIALS

The present invention relates to a novel process for dyeing wool or wool-containing fibre materials.

It is known in the art to dye wool or wool-containing fibre materials in the presence of dyeing assistants so as to counteract fibre damage that occurs in particular in high-temperature dyeing. However, these dyeing assistants often do not sufficiently counteract the setting which occurs during the dyeing process. The term setting designates an undesirable fixation of the wool fibres during the dyeing process which is caused, for example, by rearrangement of the disulfide bridges present in the wool. Such undesirable fixations can result, for example, in a deformation (flattening) of the wool yarns on spools, in a compacting of the wool fibres as well as in a loss of the wool volume.

Surprisingly, an improved process for the high-temperature dyeing of wool-containing fibre materials has now been found that is based on the use of a novel class of antisetting agents.

Accordingly, the invention relates to a process for dyeing wool-containing fibre materials with anionic dyes, which comprises dyeing said materials in the presence of a wool protective agent containing at least one acrylamide homo- or copolymer.

The acrylamide homo- and copolymers are preferably used in the form of an aqueous formulation.

The polymer used as antisetting agent is, for example, an acrylamide homopolymer or a copolymer consisting of acrylamide and acrylic acid or vinyl acetate. The preferred homo- and copolymers consist of 70 to 100% by weight of acrylamide and 0 to 30% by weight of acrylic acid or vinyl acetate, each based on the weight of the monomers. Acrylamide/acrylic acid copolymer are particularly preferred, in particular those having an acrylamide content of ≧70%, based on the weight of the monomers. A particularly preferred embodiment of this invention relates to the use of copolymers consisting of 75 to 90% by weight of acrylamide and 10 to 25% by weight of acrylic acid, each based on the weight of the monomers.

The homo- and copolymers used according to this invention have an average molecular weight of e.g. 800 000 to c. 15 millions, preferably of 1 to 10 millions and, particularly preferably, of 1.5 to 3 millions.

The homo- and copolymers used according to this invention are known per se or can be obtained by known methods. They can be converted into easily manageable aqueous formulations by simply adding the polymers to water and mixing them. Conveniently, aqueous solutions or dispersions of the acrylamide homo- or copolymers are used having a dry content of typically 0.05 to 10% by weight and, preferably, of 0.5 to 3% by weight.

The amounts in which the polymers are added to the dyeing liquor according to this invention are conveniently in the range from 0.0001 to 2 g/l liquor, preferably from 0.0005 to 1 g/l liquor and, particularly preferably, from 0.005 to 0.5 g/l liquor.

The wool protective agents used according to this invention may contain one or several different acrylamide homo- or copolymers.

The aqueous solutions of the acrylamide homo- or copolymers used according to this invention can contain further components, typically additional antisetting agents such as $H_2O_2$, levelling agents and dyeing accelerators, for example fatty alcohol alkoxylates or fatty amine alkoxylates, or antibacterial agents, e.g. chloroacetamide.

The procedure is typically carried out by first pretreating the wool-containing fibre material with the wool protective agent in an aqueous bath and then dyeing it by adding the dye to this bath. The procedure can also be carried out by treating the goods to be dyed concurrently with the wool protective agent and the dye in an aqueous bath.

The wool-containing fibre may be wool itself or may consist typically of wool/polyamide or wool/polyester blends. Wool/synthetic polyamide blends are preferably dyed with anionic dyes, and wool/polyester blends are preferably dyed with disperse and anionic dyes. Those skilled in the art will be familiar with suitable anionic and disperse dyes.

The fibre material may be in any form of presentation, typically in the form of yarns, flocks, slubbing, knitted goods, bonded fibre fabrics or, preferably, wovens.

The blended fabrics are preferably wool/polyester blends that normally contain 20 to 50 parts by weight of wool and 80 to 50 parts by weight of polyester. The preferred blends for the process of this invention contain 45 parts of wool and 55 parts of polyester.

The liquor to goods ratio in the inventive process can vary over a wide range and is typically 1:1 to 1:100 and, preferably, 1:10 to 1:50.

In addition to containing the dye, water and the wool protective agent, the dyebath may contain further customary ingredients, conveniently selected from among mineral acids, organic acids and/or salts thereof which serve to adjust the pH of the dyebath, and also electrolytes, levelling agents, wetting agents and antifoams, as well as—for dyeing wool/polyester blends—carriers and/or dispersants.

The pH of the dyebath may conveniently be in the range from 2 to 6.5, preferably from 2 to 5.5 and, particularly preferably, from 2 to 4.5. The novel process is normally carried out in the temperature range from 60° to 130° C.

If the material to be dyed is wool alone, dyeing is preferably carried out by the exhaust process, typically in the temperature range from 60° to 106° C., preferably from 95° to 98° C. The dyeing time can vary, depending on the requirements, but is preferably 60–120 minutes.

Polyester/wool blends are conveniently dyed in a single bath from an aqueous liquor by the exhaust process. Dyeing is preferably carried out by the high-temperature process in closed, pressure-resistant apparatus at temperatures above 100° C., conveniently from 110° to 125° C. and, preferably, from 118°–120° C., under normal or elevated pressure.

The blended fabrics can also be dyed by the customary carrier dyeing process at temperatures below 106° C., typically in the temperature range from 75° to 98° C., in the presence of one or more than one carrier.

The dyeing of the polyester/wool blends can be carried out such that the goods to be dyed are treated first with the wool protective agent and, if appropriate, the carrier, and then dyed. The procedure may also be such that the goods to be dyed are treated simultaneously with the wool protective agent, the dyes and optional dyeing assistants. The preferred procedure comprises putting the textile material into a bath that contains the wool protective agent and further optional dyeing assistants and which has a temperature of 40°–50° C., and treating the material for 5 to 15 minutes at this temperature. Afterwards the temperature is raised to c. 60°–70° C., the dye is added, the dyebath is slowly heated to dyeing temperature and dyeing is carried out for c. 20–60 minutes, preferably for 30–45 minutes, at this temperature. At the conclusion, the liquor is cooled to about 60° C. and the dyed material is finished in customary manner.

By means of the novel process it is possible to dye wool or wool/polyester blends with markedly reduced setting.

The antisetting effect of a wool protective agent can be determined, inter alia, in general accordance with A. M. Wemyss and M. A. White, Proc. Ind. Japan-Australia, Joint Symp. on Objective Measurement, Kyoto (1985), page 165, by punching out circles from woolen test fabric, folding these circles in the middle and sewing them together at the edge. The samples are then dyed compressed in the presence of the wool protective agent. The samples are then opened and one or several threads each are pulled out. After a relaxation time in warm water, the angle of the threads is measured. The more the previously compressed yarn has opened and the more the angle approximates 180°, the better the antisetting effect of the wool protective agent. An angle of c. 90° to 180° and, preferably, of 140° to 180° indicates a good antisetting effect.

The wool-containing fibre materials dyed in the presence of an antisetting agent of this invention usually have inhanced fabric strength, tear strength and rub fastness, as well as reduced hygric expansion and lower deformation of the textile material, and the goods mat less and have a better handle.

The following Examples illustrate the invention. Parts and percentages are by weight.

EXAMPLE 1

100 parts of a wool fabric are pretreated for 10 min. at 40° C. in an Ahiba dyeing apparatus with a liquor containing 2.5 parts of a 1% solution of a copolymer consisting of c. 15% of acrylic acid and 85% of acrylamide (molecular weight c. 2 millions) and 0.75 part of an alkylaryl polyglycol ether sulfate (e.g. Albegal® FFA) in 2500 parts of water and which is adjusted to pH 4.5 with acetic acid. 1 part of a levelling agent (e.g. Albegal® SET), 2.5 parts of sodium acetate and 5 parts of Glauber's salt are then added and the mixture is kept for a further 10 min. at this temperature. After adding 1 part of a dye mixture consisting of 5.5% by weight of the compound of formula

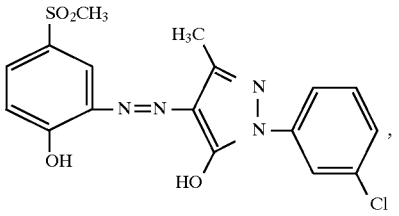

1:2 Cr complex, 23.2% by weight of the compound of formula

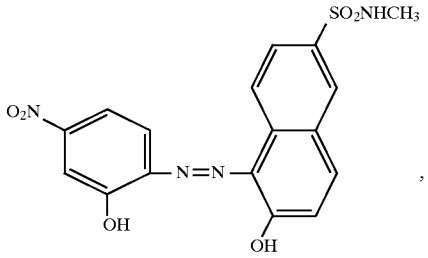

1:2 Co complex,

21% by weight of the compound of formula

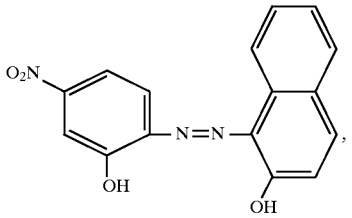

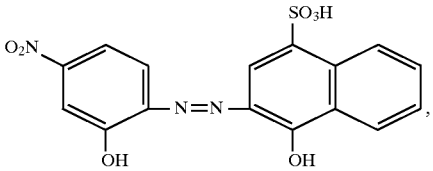

asymmetric 1:2 Cr complex, 32.7% by weight of the compound of formula

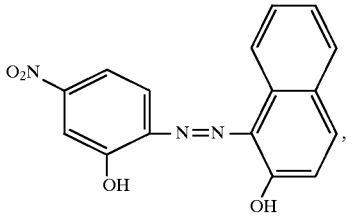

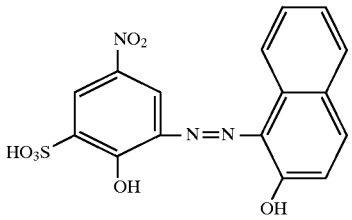

asymmetric 1:2 Cr complex, and 17.6% by weight of spent sulfite liquor, the liquor is heated at a heating rate of 1.5° C./min to 80° C., kept for 15 minutes at this temperature, heated further to boiling temperature (c. 98° C.) and dyeing is carried out for 60 minutes at this temperature. After cooling to 60° C., washing-off is carried out in customary manner. A rubfast level grey dyeing having low setting is obtained.

EXAMPLE 2

Example 1 is repeated, adding in addition to the 2.5 parts of the 1% solution of a copolymer consisting of c. 15% of acrylic acid and 85% of acrylamide (molecular weight c. 2 millions) 2.5 parts of 35% $H_2O_2$ solution, which also gives dyeings having good properties and low setting.

EXAMPLE 3

Example 2 is repetaed, replacing the 2.5 parts of a 1% solution of a copolymer consisting of c. 15% of acrylic acid and 85% of acrylamide (molecular weight c. 2 millions) with 2.5 parts of a 1% solution of a polyacrylamide homopolymer having a molecular weight of ≧2 millions, which also gives dyeings having good properties and low setting.

EXAMPLE 4

Example 2 is repeated, replacing the 2.5 parts of a 1% solution of a copolymer consisting of c. 15% of acrylic acid and 85% of acrylamide (molecular weight c. 2 millions) with 2.5 parts of a 1% solution of a copolymer consisting of c. 30% of acrylic acid and 70% of acrylamide (molecular weight ≦1 million), which also gives a dyeing having good properties and low setting.

COMPARISON EXAMPLE 1

Example 1 is repeated, but dyeing is carried out without the addition of the 2.5 parts of the 1% solution of a copolymer consisting of c. 15% of acrylic acid and 85% of acrylamide (molecular weight c. 2 millions), which gives a dyeing with high setting.

EXAMPLE 5

100 parts of a wool fabric are pretreated for 10 min. at 40° C. in 2000 parts of an aqueous liquor containing 4 parts of a 1% solution of a copolymer consisting of c. 15% of acrylic acid and 85% of acrylamide (molecular weight c. 2 millions) and 1.5 parts of a levelling agent (e.g. Miralan® TOP). A dye mixture containing 0.3 part of dye mixture containing the compounds of formulae

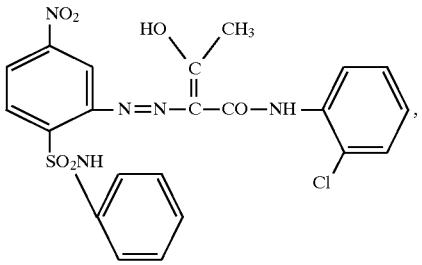

1:2 Co complex, and

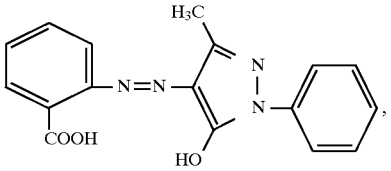

1:2 Cr complex, 0.6 part of dye mixture containing the compounds of formulae

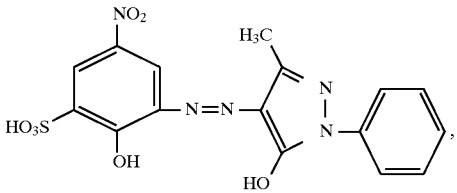

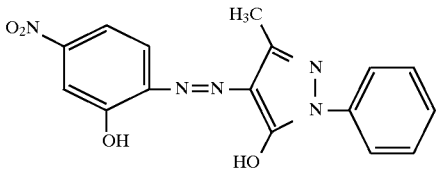

asymmetric 1:2 Cr complex, and

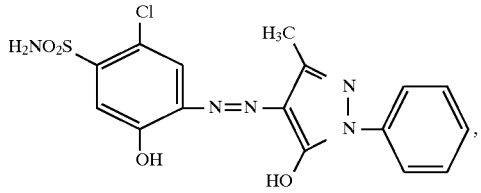

1:2 Cr complex, and 0.2 part of the dye mixture according to Example 1, is then added and the pH of the dyeing liquor is adjusted to 4 with formic acid. The liquor is then heated at a heating rate of 1.5° C./min to boiling temperature (c. 98° C.), dyeing is carried out for 20 minutes at this temperature and the liquor is then cooled to 70° C. After a conventional washing-off, a rubfast level brown dyeing with low setting is obtained.

COMPARISON EXAMPLE 2

Example 5 is repeated, but dyeing is carried out without the addition of the 2 parts of the 1% solution of a copolymer consisting of c. 15% of acrylic acid and 85% of acrylamide (molecular weight c. 2 millions) and without the 1.5 parts of levelling agent, which gives a dyeing having a high setting.

What is claimed is:

1. A process for dyeing wool-containing fibre materials with anionic dyes, with reduced setting which comprises applying to said materials an antisetting agent, which antisetting agent is an acrylamide homo- or copolymer consisting essentially of 70 to 100% by weight of acrylamide and 0 to 30% by weight of acrylic acid or vinyl acetate, each based on the weight of the monomers, and wherein the acrylamide homo- or copolymer has a molecular weight of 800,000 to 15 million.

2. A process according to claim 1, wherein the acrylamide homo- or copolymer is in the form of an aqueous formulation.

3. A process according to claim 1, wherein the acrylamide homo- or copolymer is an acrylamide/acrylic acid copolymer having an acrylamide content of ≧70% by weight, based on the weight of the monomers.

4. A process according to claim 3, wherein the acrylamide/acrylic acid copolymer consists of 75 to 90% by weight of acrylamide and 10 to 25% by weight of acrylic acid, each based on the weight of the monomers.

5. A process according to claim 1, wherein the acrylamide/acrylic acid homo- or copolymer has a molecular weight of 1 to 15 millions.

6. A process according to claim 1, wherein the acrylamide homo- or copolymer is present in the dyeing liquor in an amount of 0.0001 to 2 g/l liquor.

7. A process according to claim 1, wherein the wool protective agent additionally contains $H_2O_2$.

8. A process according to claim 1, which comprises contacting the wool-containing fibre material in an aqueous dyebath containing the acrylamide homo- or copolymer with the dye at pH 2 to 6.5 and in the temperature range from 60° to 130° C.

9. A process according to claim 1, wherein the acrylamide/acrylic acid homo- or copolymer has a molecular weight of 1.5 to 3 million.

10. A process according to claim 1, wherein the acrylamide homo- or copolymer is present in the dyeing liquor in an amount of 0.0005 to 1 g/l liquor.

* * * * *